United States Patent [19]

Komura et al.

[11] Patent Number: 4,802,841

[45] Date of Patent: Feb. 7, 1989

[54] OPERATION APPARATUS

[75] Inventors: Masahiko Komura; Masafumi Ohno, both of Aichi, Japan

[73] Assignee: Rinnai Corporation, LaGrance, Ga.

[21] Appl. No.: 74,372

[22] Filed: Jul. 16, 1987

Related U.S. Application Data

[63] Continuation-in-part of Ser. No. 785,703, Oct. 9, 1985, abandoned.

[30] Foreign Application Priority Data

Dec. 11, 1984 [JP] Japan ..... 59-260083

[51] Int. Cl.[4] ..... F23Q 9/08

[52] U.S. Cl. ..... 431/47; 431/53; 431/57; 431/59; 431/80

[58] Field of Search ..... 431/46, 47, 53, 57, 431/59, 80

[56] References Cited

U.S. PATENT DOCUMENTS

| | | | |
|---|---|---|---|
| 2,628,677 | 2/1953 | Strobel | 431/57 |
| 2,895,554 | 7/1959 | Seegert | 431/53 |
| 3,938,935 | 2/1976 | Engelbert | 431/47 |

*Primary Examiner*—Carroll B. Dority, Jr.

*Attorney, Agent, or Firm*—Nilsson, Robbins, Dalgarn, Berliner, Carson & Wurst

[57] ABSTRACT

An apparatus which is operated for opening and maintaining the flow of a gaseous fuel to a burner only after the fuel is ignited in a gas appliance, such as a gas room heater. More specifically, the apparatus has a lever with three operating positions, a starting position, an intermediate position, and a final position. From the starting position, which is an inoperative mode, the lever is capable of being moved in a first direction to an intermediate position wherein actuation of a valve to the fuel source occurs allowing fuel to enter into the burner, and a final position wherein ignition of the fuel in the burner is actuated. A continuous force urging the lever in a second or opposite direction is included as well as a locking mechanism for holding the lever in the intermediate position, which locking mechanism is activated only after the lever has first been moved to the final position, hence avoiding the condition where the burner is continuing to be supplied with fuel without ignition of the fuel.

18 Claims, 4 Drawing Sheets

OPERATION APPARATUS

RELATED APPLICATIONS

This application is a continuation-in-part of U.S. patent application No. 785,703, filed on Oct. 9, 1985, now abandoned, and assigned to the same assignee as the instant application.

FIELD OF THE INVENTION

The field of art to which the invention pertains is the field of gas room heaters, specifically, to a fuel flow control device for gas room heaters.

BACKGROUND AND SUMMARY OF THE INVENTION

This invention relates to operation apparatus which is operable for opening and maintaining the flow of fuel upon actuation of the ignition operation apparatus in a gas appliance such as a gas room heater.

There has been hitherto proposed operation apparatus having an operation lever which is movable from a starting end position to a final end position by pushing it against the action of a return spring, and a lock member which is operable to stop the operation lever at an intermediate position during returning movement of the operation lever caused by the action of the return spring. Used in a gas appliance, the operation lever serves to control to open and close a gas valve interposed in a gas passage connected to a gas burner, and an ignition switch for operating an ignition plug provided near the burner, so that there may be obtained a valve closed condition at the starting end position of the operation lever, a valve open and an ignition switch closed condition at the final end position of the lever, and a valve open condition at the intermediate position of the lever. This operation apparatus is inconvenient, however, in that the course of pushing operation thereof, if the operation lever is released from pushing before reaching the final end position, that is, before completion of the pushing operation thereof, the operation lever member is then stopped by the lock member at the intermediate position thereof, that is, in the valve open condition thereof, and thus the burner is supplied with gas under the condition that the burner is not yet ignited.

According to the present invention, there is provided operation apparatus comprising an operation member which is movable from a starting position to a final position against spring-action, and a lock member which is operable to stop the operation member at an intermediate position during return movement of the operation member caused by said spring-action, this lock member being normally kept in an inoperative condition in which it is ineffective to stop the operation member, and being brought into an operative condition in which it is effective to stop the operation member only when the operation member is first moved to its final position. Thus, in this apparatus the operation member will be stopped at its intermediate position when returning thereto under the action of the return spring only if the member was previously moved all the way to its final end position.

DETAILED DESCRIPTION

Figure 1:
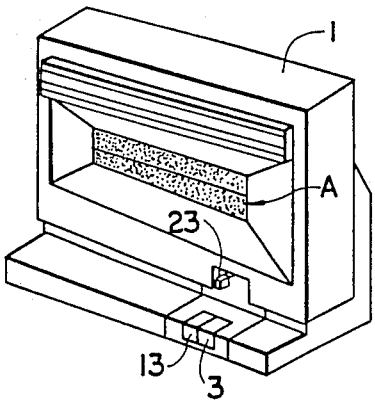
FIG. 1 is a perspective view of a gas room heater.

In FIG. 1, the numeral 1 denotes a gas room heater body having one or more gas burners and in the remaining Figures, the numeral 2 denotes a machine frame and the numeral 3 denotes an operation member in the form of an operation lever (called hereinafter "a first operation lever") pivotally mounted on a shaft 4 in the machine frame 2.

Figure 9:
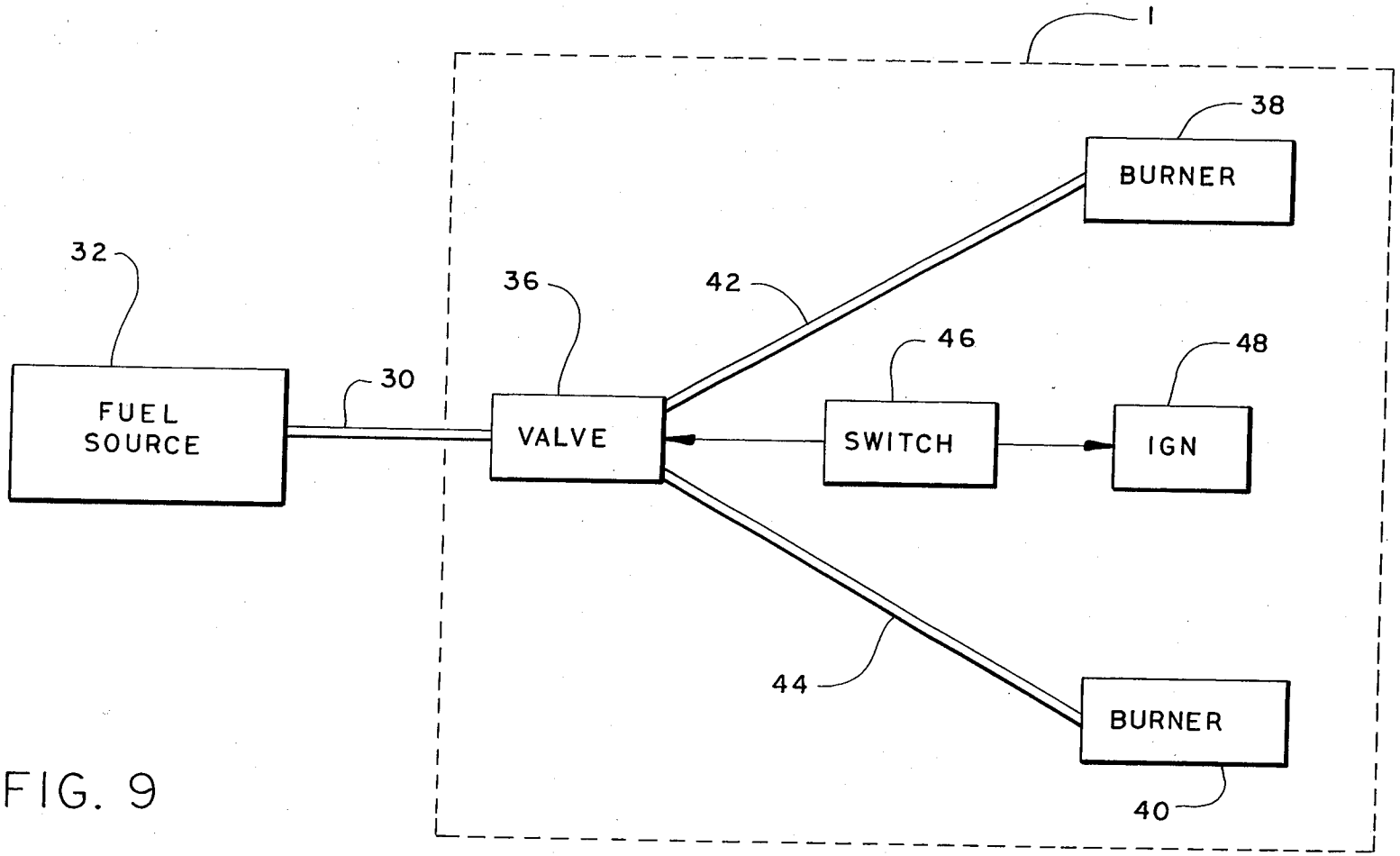
FIG. 9 is a block diagram of a room heater including two burners and the flow control operation apparatus of the invention, which room heater is connected to a source of fuel.

In FIG. 9, a schematic representation of the gas room heater 1 is shown connected via a fuel conduit 30 to a fuel source 32. The fuel source 32 is any conventional source of hydrocarbon fuel, e.g. natural gas. This source 32 may be a transportable pressurized tank which is filled with the fuel, or may be a conventional fuel line run into a house, not shown, to which various fuel appliances can be connected. The precise type of fuel source 32 is not critical to the invention. Further, the fuel conduit 30 is a fuel hose or any other suitable conduit or pipe and is also not critical to the invention. This conduit 30 is connected at one end to a suitable coupling, not shown, of the fuel source 32 and at the other end to a coupling of the room heater 1, as seen generally at 34 in FIG. 2. This coupling is mounted to a valve which is generally seen in FIG. 9 at 36.

Figure 2:
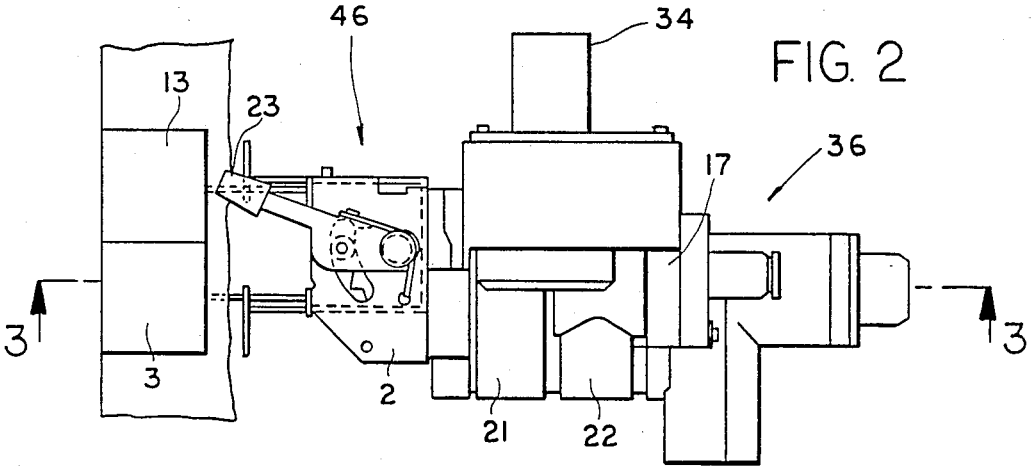
FIG. 2 is a top plan view of an important portion of the room heater of FIG. 1.
Figure 3:
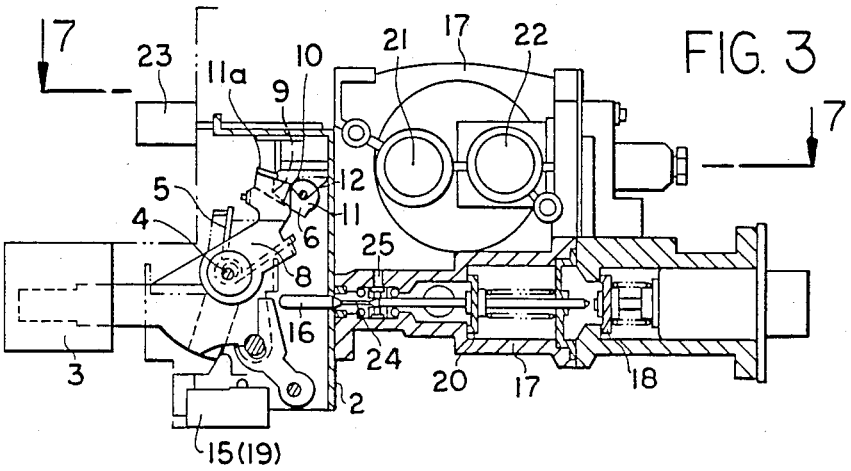
FIG. 3 is a sectional view taken along line 3—3 of FIG. 2.

The valve 36 connects to two separate burners 38 and 40 which are included in the room heater 1. The connection of the burners 38 and 40 to the valve 36 is via two separate fuel lines 42 and 44. Each of these fuel lines 42 and 44 are connected to separate connecting openings, as seen in FIGS. 2 and 3, at 21 and 22, respectively, through which the fuel can be directed either simultaneously or separately. As will be described more fully herein, the opening through which the fuel flows is selected by the operation of a change-over valve, seen at 26 in FIG. 7, by the appropriate moving of a lever, seen at 23 in the Figures.

Furthermore, as will be described more fully herein, the opening and closing of the valve 36 is controlled by the operation apparatus 46. This operation apparatus 46 is constructed to not only operate the valve 36, but also to operate the ignitor 48. More specifically, the operation apparatus 46 is designed to simultaneously operate both the opening of the fuel valve 36 and the activation of the ignitor 48, but will only cause the valve 36 to remain open if the ignitor 48 is properly activated. Otherwise, the valve 36 is maintained in a closed condition by the operation apparatus 46.

The ignitor 48 is any conventional device which will generate a spark upon being supplied current. For example, the ignitor 48 may be a suitable device electrically connected to a switch, as later described a switch 15, which is selectively operated to cause a spark which will ignite fuel being emitted at the burners 38 and/or 40. The ignitor 48 is not critical to the invention and will not be described in any further detail herein.

Figure 4:
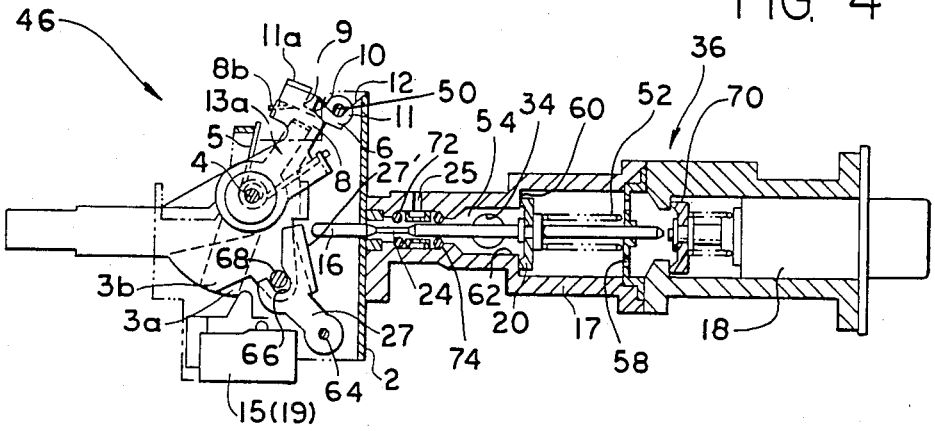
FIGS. 4–6 are similar sectional views showing different operating conditions.
Figure 5:
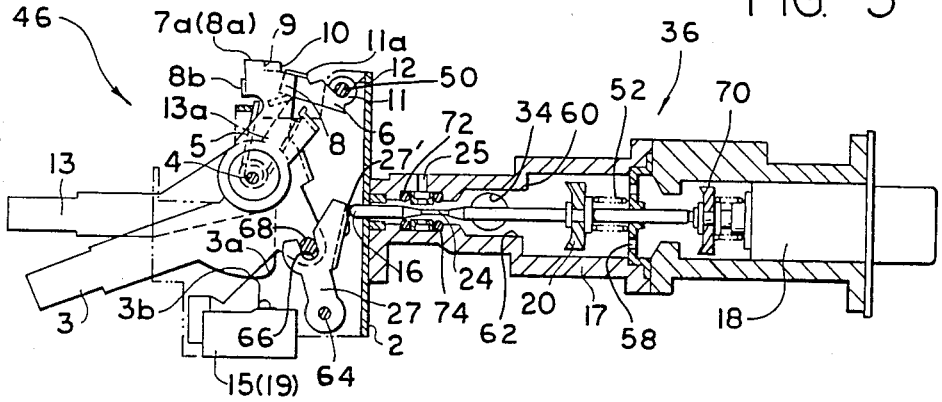

Referring to FIGS. 4–6, and 7, the apparatus 46 will be described in greater detail. The apparatus 46 includes a first operation lever 3 which is operated to open the valve 36 by pushing it in a first direction from a starting end position, that is an upper horizontal level as shown in FIG. 4, to a final end position, that is an inclined position as seen in FIG. 5, while being resiliently urged in a second opposite direction. The operation apparatus 46 also includes a lock member 6 which is effective to hold the operation lever 3, after it is released, at an intermediate position against the resilient urging of the lever 3 in the second opposite direction. Thus the lock member 6 can prevent the lever 3 from returning to the starting end position, as seen in FIG. 4.

As will be described more fully herein, the lock member 6 will only function to prevent the return of the lever 3 to the starting end position if the lever 3 has first been moved fully in the first direction to reach the final end position. By moving the lever 3 in the first direction the valve 36 is opened, and only upon moving the lever 3 entirely in the first direction to reach the final end position will the ignitor 48 be operated. Thus if the lever 3 is not fully moved to the final end position to operate the ignitor 48 then the lock member 6 will not prevent the return of the lever 3 to the starting end position. This ensures the closing of the valve 36 to prevent leakage of fuel.

In more detail, the first operation lever 3 includes a body out from which extends a limb. The lever 3 body is pivotally mounted about a shaft 4. The lever 3 body is integrally formed with an upwardly projecting cam plate 7 (called hereinafter "main cam plate"). This main cam plate 7 is formed on its uppermost end with a cam surface 7*a*. This cam surface 7*a* is formed with a downwardly directed shoulder or an engaging portion 9 for engaging a portion of the lock member 6.

The lock member 6, which is formed from a generally a flat planar body or supporting arm 11, includes a portion bent substantially perpendicular to the supporting arm 11 to form an outwardly jutting member 11*a*. This outwardly jutting member 11*a* is formed at the forward end of the supporting arm 11. The supporting arm 11 is pivotally mounted to a shaft 50 and is urged by a spring 12 in a generally downward direction. That is, in such a direction that the bent member 11*a* is brought into abutment with the cam surface 7*a* of the main cam plate 7.

Accordingly, when the first operation lever 3 is in the starting end position (FIG. 4), the lock member 6, that is outwardly jutting member 11*a* will rest upon the cam surface 7*a*, and is kept in an elevated position against the action of the spring 12. But if the first operation lever 3 is operated by pushing it downward, the outwardly jutting member 11*a* of the lock member 6 will move along the cam surface 7*a* until reaching the shoulder or engaging portion 9, at which time the jutting member 11*a* will move downward across the shoulder or engaging portion 9. This releases the lock member 6 from its abutment with the cam surface 7*a*, as seen in FIG. 5. When the operation lever 3 is released, that is no longer pushed, the lever 3 will return in the second direction towards the starting end position, under the urging influence of a resilient mechanism, e.g. a spring. However, the lever 3 will be prevented from returning to the starting end position by the engagement of an edge of the outwardly jutting member 11*a* of the lock member 6 with the shoulder or engaging portion 9. This causes the lever 3 to remain at an intermediate position (FIG. 6), which as will be described allows for the continued flow of fuel to the various burners 38 and/or 40.

As stated, the lever 3 is normally urged in a second direction under the influence of a resilient means, e.g. a spring. More particularly, the lever 3 is urged rearward, in the second direction, by the action of either or both of the springs 5 or 52.

The spring 5 acts directly upon a subsidiary cam plate 8, which will be described more fully herein. This subsidiary cam plate 8 is pivotally mounted for rotation about the shaft 4 along side main cam plate 7 of the lever 3. This cam plate 8 is formed with a claw member 8*b* which juts laterally outward and is positioned to be abutted against by the main cam plate 7 of the lever 3, when the lever 3 is moved forward in the first direction from its starting end position. That is, the main cam plate 7 will always abut up against the claw member 8*b* of the subsidiary cam plate 8 when not in the starting end position. Since the spring 5 acts to urge the subsidiary cam plate 8 in the second direction the spring 5 will also, indirectly, urge the main cam plate 7, and thus the lever 3, rearward, in the second direction towards the starting end position, as seen in FIG. 4.

The spring 52 may also function to urge the lever 3, and thus main cam plate 7 in the second rearward direction. This spring 52 is positioned in the valve housing 17 of the valve 46. Specifically, the spring 52 rests in the valve cavity, seen generally at 54, about a valve rod 16. The valve 46 also includes one valve head or membrane 20 which journals the valve rod 16. The spring 52 rests between this valve membrane 20 and a bushing 58 which is fixed at a location in the valve housing 17. This bushing 58 is formed with a hole through which the valve rod 16 is slidably positioned. The valve membrane 20 normally rests against a wall 60 of the valve housing 17, which wall 60 is formed with an opening 62.

As seen in FIGS. 3–6, the valve rod 16 extends out from the valve housing 17 and engages an arm 27' of a cam armature 27. This armature 27 is pivotally mounted to a shaft 64, and is further formed with a notch 66 in which is rested a peg 68, which peg 68 is secured to the main cam plate 7 of lever 3. When the lever 3 is moved in the first direction toward the final end position the peg 68 will move along with the main cam plate 7 in a generally rearward direction, that is towards the valve 46, causing the cam armature 27 to also move rearward as seen successively in FIGS. 4–6. This forces the valve rod 16 rearward into the valve housing 17 against the urging action of the spring 52. Since the valve rod 16 remains in abutment with the arm 27' the outward urging of the valve rod 16 by the spring 52 will also urge the lever 3 in the second direction towards the starting end position.

The lever 3 can be released to allow for its travel in the second direction to the starting end position by lifting the edge of the member 11*a* up away from the shoulder or engaging portion 9 by pushing lock member 6 upward using any proper means. This releases the engagement between the lock member 6 and the lever 3.

As stated the valve 46 includes a valve housing 17 in which is slidably positioned the rod 16. Further, one end of the rod 16 faces the cam armature 27, which is connected via the peg 68 to the first operation lever 3. The opposing end of the rod 16 faces a valve membrane 70 of an electromagnetic safety valve 18 which is positioned to the rear thereof. A first portion or subvalve of the valve 46 is opened when the valve membrane 20 is pushed rearward, that is, as the rod 16 is being pushed into the valve housing 17. Furthermore, a second portion or subvalve is opened when the rod 16 end engages and drives the valve membrane 70 towards the electromagnetic safety valve 18 as the rod 16 is being pushed fully into the valve housing 17.

As stated when the first operation lever 3 is operated by pushing it downward from its starting end position (FIG. 4) toward a final end position (FIG. 5), the slidable rod 16 is pushed inward the valve housing 17 moving rearward toward the position shown in FIG. 5. During this movement, the valve membrane 20 provided on the rod 16 moves away from the valve housing wall 60 to open the first subvalve, and the second subvalve is opened when the membrane 70 of the electromagnetic safety valve 18 positioned to the rear. Also in the course of this pushing operation of the lever 3 a switch 19 of an electronic forcibly holding circuit for activating the electromagnetic safety valve 18 is closed by a projecting portion 3*a* of the lever 3, so that the valve 18 is kept in its operative condition. The forcibly holding circuit as well as the electromagnetic safety valve 18 are of conventional design and will not be described in detail herein.

Figure 6:
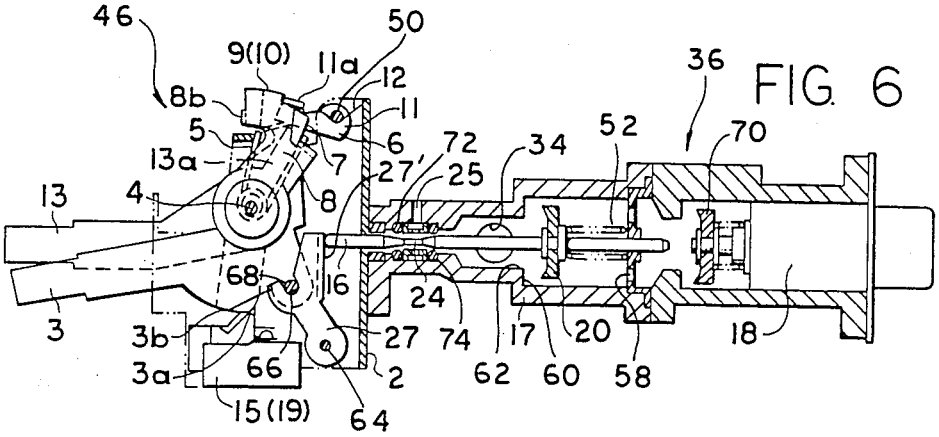

Thereafter, when the final end position of the lever 3 is reached, that is, at the time of completion of the pushing operation movement as shown in FIG. 5, a switch 15 is pushed closed by a second projecting portion 3*b* of the first operation lever 3. This switch 15, when operated by the second projecting portion 3*b* activates the ignitor 48, as seen in FIG. 9. The releasing of the lever 3 allows the same to move back a little until stopped at an intermediate position by the lock member 6 as seen in FIG. 6. This intermediate position allows the first and second subvalves to remain open as seen in FIG. 6. Further, since the fuel of the burners have been ignited by the activation of the ignitor 48 the electromagnetic safety valve 18 is kept open by the operation of the forcibly holding circuit which supplies an electromotive force in response to a current supplied by a thermocouple (not illustrated) exposed to the burner, and thereby the burner is kept in its burning condition since both subvalves remain open. Then, if the lock member 6 is pushed upward by any proper means to be disengaged from the engaging portion 9, the first operation lever 3 returns to the original starting end position shown in FIG. 4. This will close the first subvalve by allowing the membrane 20 to return to its position against the valve wall 60, which will interrupt the flow of fuel to the burners and extinguish the flame. This will then deactivate the forcible holding circuit and allow the electromagnetic valve 18 to close.

As so far described, the effect is not especially different from what has been previously proposed, but to avoid the inconveniences already described that otherwise arise from releasing the lever 3 before the final end position is reached, in the present apparatus the lock member 6 is so arranged as to be kept in an inoperative condition in an ordinary case and be brought into its operative condition only when the operation lever 3 is moved, by pushing it, to the final end position.

In more detail, as stated in the present apparatus there is provided a subsidiary cam plate 8 which is pivotally supported on the shaft 4 along side of the main cam plate 7, so that if the first operation lever 3 is pushed down for operation, the subsidiary cam plate 8 is driven in the same direction by the claw member 8*b* which projects out from the subsidiary cam plate 8 and is engaged by a front side surface of the main cam plate 7. In addition, an upper surface of the subsidiary cam plate 8 is formed as a cam surface 8*a* which is nearly of the same shape as the cam surface 7*a* of the main cam plate 7 but extends further over a greater length in the direction towards the lock member 6 than does the surface 7*a*. This cam surface 8*a* is also formed with a shoulder or engaging portion 10, which engaging portion 10 is positioned closer to the lock member 6 than is the shoulder or engaging portion 9 of the main cam plate 7.

Accordingly, in an ordinary case the bent member 11*a* of the arm 11 of the lock member 6 is supported from below by the cam surfaces 7*a* and 8*a*. This keeps the bent member 11*a* in an elevated uncooperative condition with respect to the shoulder or engaging portion 9 of the main cam plate 7. If, therefore, the first operation lever 3 is moved by pushing it downward to the final end position, that is, if pushing is completed to the position shown in FIG. 5, the lock member 6 comes off the cam surfaces 7*a* and 8*a* and is brought into engagement with the engaging portions 9 and 10 formed in the cam surfaces 7*a* and 8*a*, as clearly shown in FIG. 8.

Accordingly, the lock member 6 cannot be changed over to its operative condition from its inoperative condition as long as the first operation lever 3 is not pushed to the final end position. That is, the bent member 11*a* will not drop from the camming surfaces 7*a* and 8*a* into engagement with the shoulder or engaging portions 9 and 10 until the lever 3 is pushed completely down to the final end position. It is at this final end position in which the valve is fully opened by the movement of the rod 16 as well as the activation of the ignitor 48 by the operation of the switch 15.

In the illustrated embodiment the mechanism used to push the lock member 6 upward, and thus move the bent member 11*a* out from engagement with the engaging portions 9 and 10 is a second operation lever 13 which is pivotally supported on the same shaft 4, as is the first operation lever 3 and subsidiary cam plate 8, but is positioned on the opposite side of the first operation lever 3. The second operation lever 13 is operated by pushing it against the action of a spring (not illustrated), which moves a projecting member 13*a* of the lever 13 upward against the lock member 6. This projecting member 13*a* exerts a force upon a lower surface of the lock member 6, which moves the edge of the bent member 11*a* out from engagement with both of the shoulders or engaging portions 9 and 10.

Figure 7:
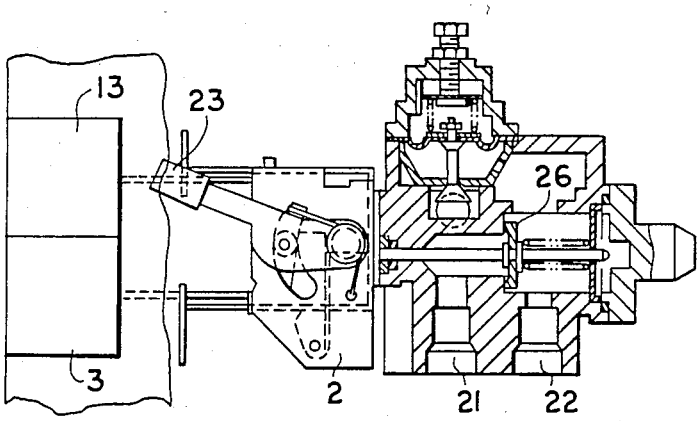
FIG. 7 is a sectional view taken along line 7—7 of FIG. 3.

Additionally, in the illustrative embodiment, the room heater 1 includes the two burners 38 and 49, with the valve housing 17 being provided, on a downstream side of the first gas valve 20, with respective connecting openings 21 and 22 for these two burners 38 and 40. These two connecting openings 21 and 22 are interconnected through a changeover valve 26 so that, as shown in FIG. 7, the changeover valve 26 may be changed over by a third operation lever 23 between such a condition that only one of the two burners is or both of the two burners obtain the necessary fuel for operation.

Additionally, an outlet opening 25 is formed in the valve housing 17 to place the fuel valve cavity 54 in fluid communication with a pilot burner. This outlet opening 25 is opened and closed by the reciprocal movement of the valve rod 16. That is, the rod 16 is formed with a narrowed portion, as seen at 24, which when moved adjacent to the opening 25 allows fuel to flow therethrough. The larger diameter portion of the valve rod 16 fits snugly between two gaskets, 72 and 74, so as to seal off the opening 25.

Figure 8:
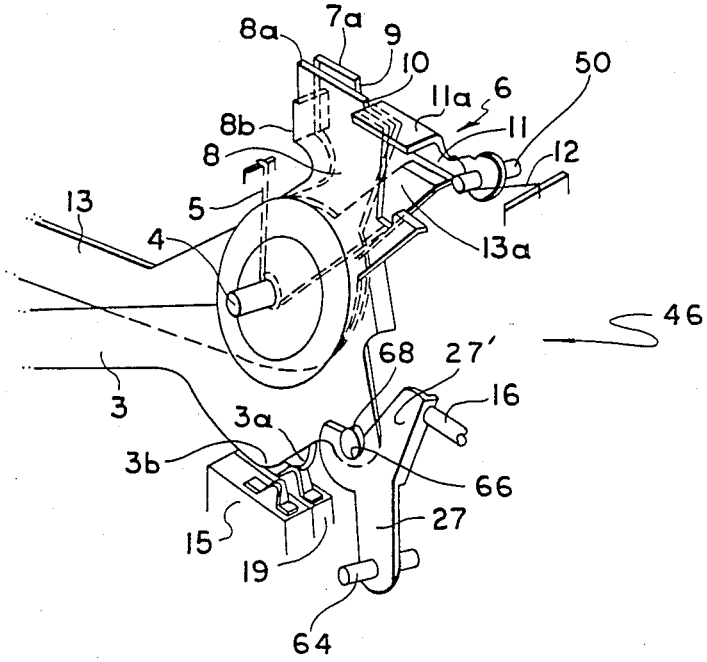
FIG. 8 is an enlarged perspective view of an important portion shown in the operation condition of FIG. 5.

In operation, if the first operation level is in its starting end position shown in FIG. 4, the lock member 6 is kept in an elevated position at which it is in abutment with the cam surfaces 7*a* and 8*a* (or at least the cam surface 8*a*). If the operation lever 3 is moved to its final end position, the lock member 6 is released from its abutment thereof and drops to engage the engaging portion 10 of the subsidiary cam plate 8, as shown in FIGS. 5 and 8. Then, if the first operation lever 3 is released from pushing the lever 3 moves in the direction of its starting end position under the urging action of the spring 5 and/or valve spring 52. If the lever 3 has not been first moved all the way to its final end position it will, upon release, return to its starting end position. If the lever 3 has been first moved to its final end position then, upon release, it is stopped and held at its intermediate position by a locking mechanism illustrated by the engagement of the engaging portion 9 of the main cam plate 7 with the lock member 6, as shown in FIG. 6.

During the foregoing operation, the switch 19 is closed by the projection portion 3*a* of the first operation lever 3, so as to activate the forcibly holding circuit. At the same time the slidable rod 16 is pushed and moved rearward by the interaction of the main cam plate 7 and the cam armature 27. Thus, the first gas subvalve is opened by the displacement of the membrane 20 away from the valve wall 60. The second gas subvalve is also maintained open by the displacement of the membrane 70 of the electromagnetic safety valve 18 rearward and also by the concurrent activation of the forcibly holding circuit, which was activated by the operation of the switch 19. Eventually, as the lever 3 reaches its final end position, as shown in FIG. 5, the switch 15 is also closed by the projection portion 3*b* of the lever 3, which activates the ignitor 48, thus causing ignition of the gas burner.

If after ignition, the operation lever 3 is released from pushing, it moves a little toward its starting end position until it is stopped at its intermediate position in which the first gas valve 20 is kept in its open condition, and the electromagnetic safety valve 18 is also kept in its open condition by the operation of the forcibly holding circuit which initiates the generation of an electromotive force in the electromagnetic safety valve 18. Overall the above discussed operation keeps one or both of the burners 38 or 40 burning.

For extinguishing the burners 38 and/or 40 the second operation lever 13 is operated by pushing it downward. This causes the lock member 6 to be pushed upward by the projection member 13*a* and elevated above each of the camming surfaces 7*a* and 8*a*. This releases the engagement of the bent member 11*a* with the engaging portions 10 and 9. Accordingly, the first operation lever 3 is returned by the return spring 5 and valve spring 52 to the starting end position, that is, to a rest condition, as shown in FIG. 4. In accordance therewith the slidable rod 16 is also returned to its original position.

Thus, the lock member 6 is so arranged as to be in its inoperative condition in an ordinary case, and to be brought into its operative condition only when the first operation lever 3 is first moved to the final end position, that is, the completed position of the pushing operation, so that an unfavorable engagement of the operation lever 3 with the lock member 6 is avoided if the operation lever 3 is released from pushing before it reaches the final end position. In this way, discharge of unburned gas in a gas room heater 1 or the like can be prevented.

While the preferred embodiment has been described and illustrated, various substitutions and modifications may be made thereto without departing from the scope of the invention. Accordingly, it is to be understood that the present invention has been described by way of illustration and not limitation.

What is claimed is:

1. A device comprising:

a gas burner;

a source of gas connected by a gas pathway to said burner;

an ignitor means positioned adjacent said burner operable for igniting said gas at said burner;

a valve means situated in said gas pathway for selectively opening or closing the gas flow through said pathway;

a first operation lever connected to said valve means and said ignitor means and movable from a starting end position in a first direction, while being normally urged in a second opposite direction, through an intermediate position, to a final end position;

a first switching means for actuating the valve means to open gas flow through said pathway when the first operation lever is in the intermediate position;

a second switch means for actuating the ignition means to cause ignition of said gas at said burner when the first operation lever is in final end position;

locking means which is partially acted upon by and moved along with said first operation lever for allowing said first operation lever to pass through said intermediate position to said final end position to ensure the operation of said ignitor means and for gripping and holding said first operation lever at said intermediate position only after said first operation lever has passed to said final end position to ensure that said valve means is maintained open to allow gas to pass through said pathway;

first spring means for resiliently urging said first operation lever in said second direction; and release means which can be brought into engagement with said locking means for releasing and allowing said first operation lever to return to said starting end position.

2. The device of claim 1 wherein said locking means includes:

a movable subsidiary cam plate which is engaged by and moved along with said first operation lever in said first direction through said intermediate position to said final end position while being normally urged in a second opposite direction;

a gripping means which is urged against said first operation lever and said movable subsidiary cam plate as they are moving in said first direction, said gripping means grasping and holding said movable subsidiary cam plate only after said movable subsidiary cam plate has reached said final end position, while allowing said first operation lever to be urged back toward said starting end position by said spring means, until at said intermediate position, whereat said gripping means grasps and holds said first operation lever at said intermediate position, whereby said gas flow is ensured;

second spring means for urging said gripping means against said first operation lever and movable subsidiary cam plate; and third spring means for urging said movable subsidiary cam plate in said second direction.

3. The device of claim 2 wherein said first operation lever and said movable subsidiary cam plate each include at least a first surface against which said gripping means is urged and travels as said first operation lever and subsidiary cam plate are moving in said first direction, which surfaces are each formed to be grasped by said gripping means at locations to allow said subsidiary cam plate and said first operation lever to be independently held at said intermediate position.

4. The device of claim 3 wherein said gripping means has at least a first edge that bears against said first operation lever and said subsidiary cam plate surfaces, and wherein said surfaces are each formed with a shoulder which said edge engages to independently hold said first operation lever and said subsidiary cam plate respectively at said intermediate position.

5. The device of claim 1 wherein said first operation lever is a rotatably mounted main cam plate having a lever extending out therefrom which is engaged by a user to rotate said cam plate in said first direction.

6. The device of claim 5 wherein said locking means includes:

a rotatably mounted subsidiary cam plate coaxially mounted adjacent to said main cam plate, said subsidiary cam plate including a member which juts out to be engaged by a formed portion of said main cam plate as said main cam plate is rotated in said first direction, whereby said subsidiary cam plate is rotated with said main cam plate, while said subsidiary cam plate is normally urged in a second opposite direction;

a gripping means which is resiliently urged against said main and subsidiary cam plates and which engages each of said cam plates for holding said main cam plate and said subsidiary cam plate at said intermediate position; and second and third spring means for resiliently urging said gripping means and said subsidiary cam plate, respectively.

7. The device of claim 6 wherein said main cam plate includes a peripheral edge for engaging and bearing against said subsidiary cam plates's outwardly jutting member, said cam plates each also having a substantial circular upper peripheral edge which are formed with first and second shoulders respectively, said second shoulder being positioned closer to said gripping means than is said first shoulder, said shoulders being selectively engaged by said gripping means to hold said first and second cam plates at said intermediate position.

8. The device of claim 7 wherein said gripping means is a pivotally mounted arm which is resiliently urged in a first direction to bear against said first and second cam plates' peripheral edges and which travels across said edges as said cam plates are being rotated in said first and second directions and which arm is formed with an edge for engaging said shoulders of said cam plates to hold said plates at said intermediate position.

9. A switching device for performing two interdependent functions, regulating the flow of fuel through a fuel valve in a gas burner and igniting said fuel, comprising:

a movable lever connected to said valve for selectively opening said valve and activating ignition of said fuel at said burner, said lever including a starting position, an intermediate position and a final end position and being movable in a first direction, while being normally urged in a second opposite direction, from the starting position through an intermediate position, at which point said lever opens said fuel valve to a final end position at which said lever activates ignition of said fuel;

locking means which is partially acted upon by and moved along with the said lever to allow said lever to pass through said intermediate point to said final end point for opening said valve and for subsequently activating ignition of said fuel, and for holding said lever at said intermediate position only after said lever has passed to said final end position and initiated said ignition;

spring means for resiliently urging said lever in said second opposite direction; and release means which can be brought into engagement with said locking means for releasing and allowing said lever to return to said starting end position.

10. The device of claim 9 wherein said locking means includes:

a movable limb which is engaged by and moved along with said lever in said first direction through said intermediate position to said final end position while being normally urged in said second opposite direction;

a gripping means which is urged against said lever and said movable limb as they are moving in said first direction, said gripping means grasping and holding said movable limb only after said movable limb has reached said final end position, while allowing said lever to be urged back toward said starting end position by said spring means, until at said intermediate position, whereat said gripping means grasps and holds said lever at said intermediate position; and second and third spring means for urging said gripping means against said lever and movable limb and for urging said movable limb in said second direction.

11. The device of claim 10 wherein said lever and said movable limb each include at least a first surface against which said gripping means is urged and travels as said lever and limb are moving in said first direction, which surfaces are each formed to be grasped by said gripping means at locations to allow said limb and said lever to be independently held at said intermediate position.

12. The device of claim 11 wherein said gripping means has at least a first edge that bears against said lever and said limb surfaces, and wherein said surfaces are each formed with a shoulder which said edge engages to independently hold said lever and said limb at said intermediate position.

13. The device of claim 12 wherein said lever is a rotatably mounted disc having a lever extending out therefrom which is engaged by a user to rotate said disc in said first direction.

14. The device of claim 13 wherein said locking means includes:

a second rotatably mounted disc coaxially mounted adjacent to said first disc, said second disc including a member which juts out to be engaged by a formed portion of said first disc as said first disc is rotated in said first direction, whereby said second disc is rotated with said first disc, while said first and second discs are normally urged in a second opposite direction;

a gripping means which is resiliently urged against said first and second discs and which engages appropriately formed portions of each of said discs for independently holding said first disc and said second disc at said intermediate position; and second and third spring means for urging said gripping means and said second disc, respectively.

15. The device of claim 14 wherein said discs each have a substantial circular peripheral edge, with said first disc having an integrally formed portion in said peripheral edge for engaging and bearing against said second disc's outwardly jutting member and wherein each of said first and second discs' peripheral edges have an integrally shoulder, respectively, which are selectively engaged by said gripping means to hold said first and second discs at said intermediate position.

16. The device of claim 15 wherein said gripping means is a pivotally mounted arm which is resiliently urged in a first direction against said first and second discs' peripheral edges, which arm travels across said edges as said discs are rotated in said first and second directions and which arm independently engages said disc shoulders to hold said discs at said intermediate position.

17. The device of claim 16 wherein said shoulder of said second disc is positioned closer to said gripping means than is said shoulder of said first disc.

18. The device of claim 17 wherein said second disc shoulder is positioned closer to said arm than is said first disc shoulder.

* * * * *